United States Patent [19]

Wagner

[11] 4,020,574

[45] May 3, 1977

[54] PIVOTED SCRAPER EJECTOR WITH HYDRAULIC MEANS TO PROVIDE LEVEL SPREAD

[75] Inventor: Ernest W. Wagner, Joliet, Ill.

[73] Assignee: Caterpillar Tractor Co., Peoria, Ill.

[22] Filed: May 7, 1976

[21] Appl. No.: 684,230

[52] U.S. Cl. ..... 37/126 AE; 214/82; 37/129

[51] Int. Cl.[2] ..... E02F 5/00; E02F 9/28

[58] Field of Search ..... 37/124 R, 126 R, 126 AB, 37/126 AC, 126 AE, 129, 8, DIG. 20, DIG. 14; 172/4.5; 214/82

[56] References Cited

UNITED STATES PATENTS

| | | | |
|---|---|---|---|
| 3,292,279 | 12/1966 | Rockwell et al. | 37/129 |
| 3,328,903 | 7/1967 | Campbell et al. | 37/129 |
| 3,452,458 | 7/1969 | Campbell et al. | 37/8 |
| 3,474,547 | 10/1969 | Campbell et al. | 37/8 |

*Primary Examiner*—E. H. Eickholt

[57] ABSTRACT

In earth-moving equipment wherein material is ejected from the bottom of a bowl through an open pivoted ejector floor and leveled by the front edge of the floor, the improvement wherein the bowl is automatically raised and lowered as the distance of the front edge of the floor below the bottom of the bowl increases and decreases, respectively, so that level spreading may be achieved.

6 Claims, 5 Drawing Figures

PIVOTED SCRAPER EJECTOR WITH HYDRAULIC MEANS TO PROVIDE LEVEL SPREAD

BACKGROUND OF THE INVENTION

This invention relates to earth-moving equipment having an open-topped scraper bowl in which earth or other material is transported and a transverse floor ejector at the bottom of the bowl, the floor ejector being pivotally mounted on the bowl for arcuate swinging movement about a horizontal axis between closed and open positions. Typically, the bowl is provided with ground-engaging wheels at its rear end and the front end of the bowl is suspended by adjustable hydraulic bowl lift cylinders from the rear end of a towing tractor.

Such equipment is used to spread a layer of material on the ground as the bowl is towed forwardly and as the floor ejector is swung rearwardly to open the bowl for gravity ejection of the material from the bowl. As the floor ejector is pivoted to open position its front edge swings below the bottom of the bowl and is used as a strike-off blade to form the top surface of the ejected layer.

It is desired that the ejected layer laid by the equipment be of constant thickness as the bowl is towed forwardly and material is ejected therefrom. However, due to the pivotal mounting of the ejector floor the vertical distance of the ejector floor strike-off blade below the bottom of the bowl will vary as the ejector floor is progressively opened and consequently the vertical distance of the strike-off blade above the ground will vary.

It is the primary object of the present invention to provide earth-moving equipment of the type set forth above with means to maintain the floor ejector strike-off blade at a constant elevation above the ground regardless of the degree of floor opening so that level spreading of a constant-thickness layer may be achieved.

SUMMARY OF THE INVENTION

In general, the primary object is met by producing a signal during at least a portion of the pivotal movement of the floor ejector, the signal being proportional to the magnitude of vertical distance of the forward edge of te ejector floor below the bottom of the bowl. The produced signal is sensed and is used to actuate the bowl lift cylinders to raise the front end of the scraper bowl when the signal increases in magnitude and to lower the bowl when the magnitude of the signal decreases, the degree of raising and lowering the bowl being proportional to the magnitude of the signal.

Thus, as the front edge of the ejector floor moves downwardly below the bowl bottom during the first portion of floor opening movement, the front end of the bowl will be raised by an amont such that the front edge will remain at a constant elevation above the ground. As the floor continues to open and its front edge moves upwardly relative to the bowl bottom, the front end of the bowl will be automatically lowered, again maintaining the front floor edge at a constant elevation with respect to ground level.

Other objects and advantages will become apparent in the course of the following detailed description.

BRIEF DESCRIPTION OF THE DRAWINGS

In the drawings forming a part of this application, and in which like parts are designated by like reference numerals throughout the same.

DESCRIPTION OF THE PREFERRED EMBODIMENT

Figure 1:
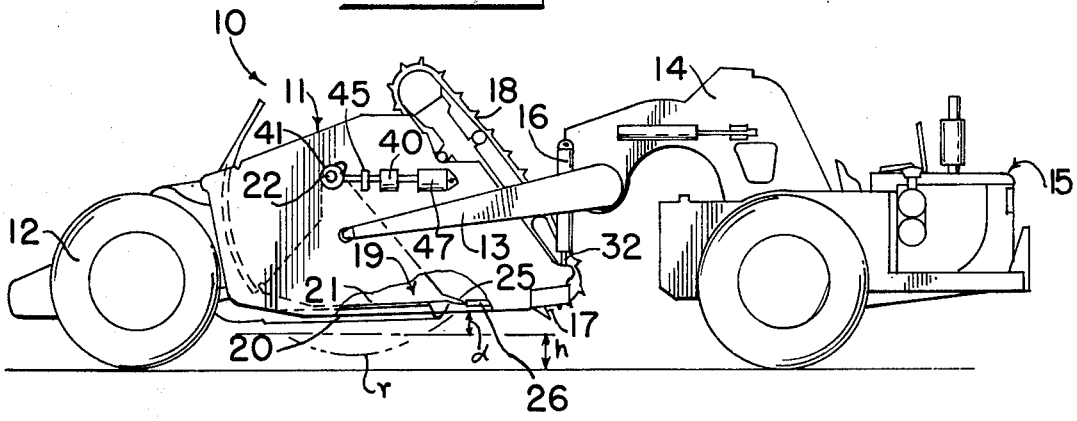
FIG. 1 is a side-elevational view of a wheel-tractor scraper embodying the present invention.

Referring now to the drawings, wherein is illustrated a preferred form of the invention, the wheel-tractor scraper 10 comprises an open-topped scraper bowl 11 having ground-engaging wheels 12 at its rear end and connected by draft arms 13 to the gooseneck 14 of the front tractor unit 15. Hydraulically-operated bowl lift cylinders 16 suspend the front end of the scraper bowl from the gooseneck and enable the front end of the scraper bowl to be raised or lowered as desired. The scraper is provided with a cutting edge 17 and an endless elevator 18 for self-loading purposes.

The scraper bowl is provided with a floor ejector 19 having a floor member 20 extending transversely across the bottom of the bowl and being generally horizontal when the floor is in its illustrated closed position. The floor ejector has upstanding side members 21 on each side thereof, each side member fixed to horizontal shaft 22, which protrudes through the side of the scraper bowl for pivotal movement of the floor ejector about the horizontal axis of the shaft. Such movement may be produced by actuation of hydraulic cylinder 23 and ram 24 which is connected between the bowl and the ejector floor by conventional means not shown.

Without the present invention, pivotal movement of the floor ejector 19 from its illustrated closed position to its rearward position opening up the bottom of the bowl will cause the front edge 25 of the floor to move through an arcuate path indicated by the dotted line *r* having a radius equal to the distance from the edge 25 of pivot axis 21 so that the front edge 25 will move downwardly relative to the bottom 26 of the bowl and then upwardly relative thereto as the ejector floor swings from its closed to half-open position and then continues to move to full-open position.

Figure 2:
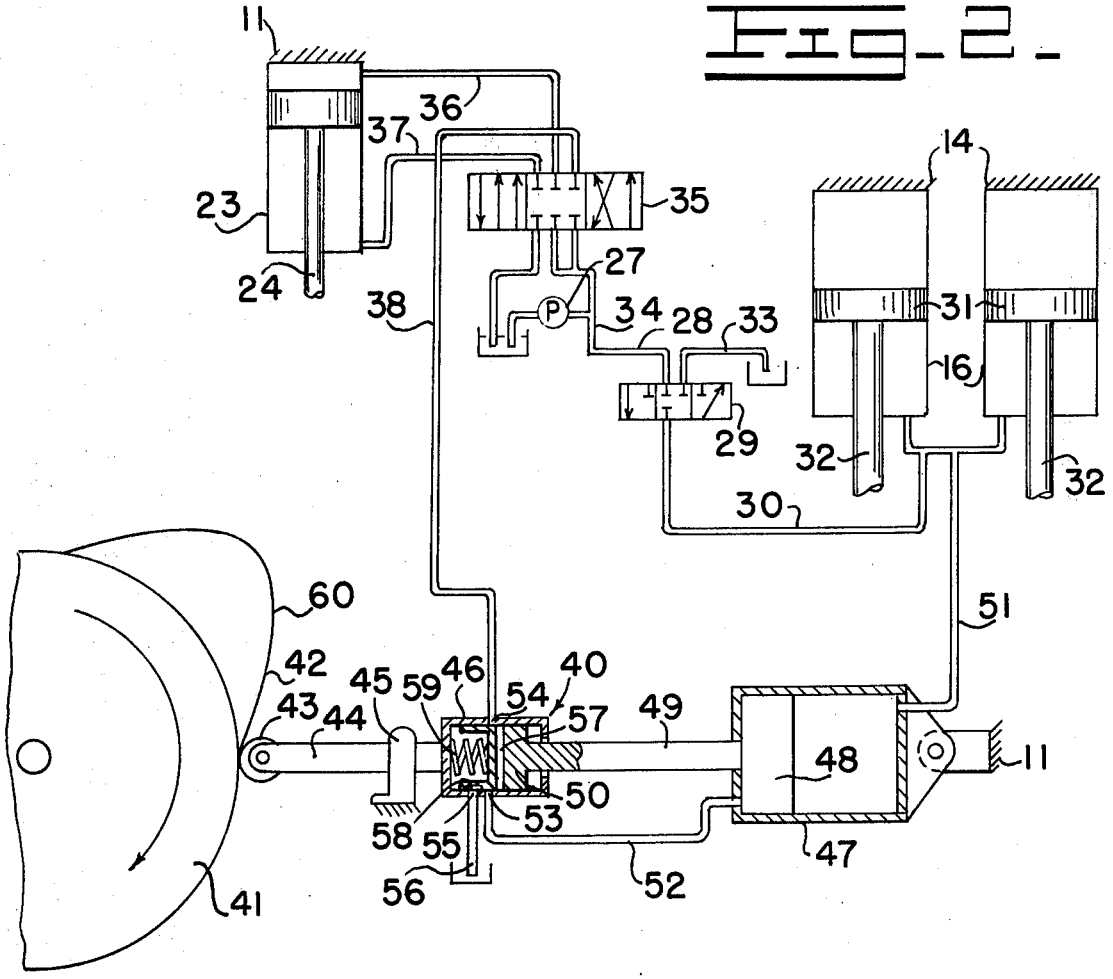
FIG. 2 is a schematic view of a hydraulic system for raising and lowering the scraper bowl of the FIG. 1 device in response to pivotal movement of the ejector floor.

The hydraulic system is shown schematically in FIG. 2. Pump 27, preferably powered by the engine of tractor 15, delivers fluid under pressure through conduit 28 to valve 29. In its illustrated position, valve 29 blocks flow through conduit 30 to maintain bowl 11 at its adjusted position. Movement of valve 29 to the right will communicate conduits 28 and 30 to cause the high pressure source fluid to be admitted to the bowl lift cylinders 16 to raise the pistons 31 and rods 32 therein and thereby raise the front end of bowl 11. Movement of valve 29 to the left allows cylinders 16 to exhaust through conduits 30 and 33 so that the front end of the bowl will lower. High-pressure fluid is also delivered by conduit 34 to valve 35 which is connected by conduits 36 and 37 to the head and rod ends of cylinder 23. Movement of valve 35 to the right or left of the illustrated positioned will control movement of ram 24 and thereby the swinging movement of the floor ejector 19 about the axis of shaft 22. Valve 35 will also supply high-pressure fluid to conduit 38 and booster valve 40 whenever valve 35 has been moved from its illustrated intermediate position.

As mentioned previously, the primary purpose of the present invention is to maintain the height of the front edge of the ejector floor at a fixed height *h* above the ground during pivotal movement of the ejector floor, so that the front edge, acting as a strike-off blade, will spread a layer having a constant thickness *h*.

The particular form of the invention illustrated herein includes a cam 41 fixed to shaft 22 for rotational movement in unison with swinging movement of the floor ejector 19, cam 41 having a cam surface 42 engaged by cam follower roller 43. Cam surface 42 is suitably shaped so that the distance from the axis of shaft 22 of the point of engagement of the cam follower 43 with the cam surface is proportional to the vertical distance of the front edge 25 of the ejector floor below the bottom of the ejector bowl for all degrees of movement of the ejector floor during the desired portion of swinging movement of the ejector floor. Cam surface 42 will thus produce a signal having a magnitude proportional to the magnitude of such vertical distance, the signal being sensed by cam follower roller 43 which is mounted on the end of rod 44 and confined to reciprocable movement by slide bearing 45 mounted on the scraper bowl. Housing member 46 of valve 40 is fixed to the other end of rod 44 for reciprocable movement in unison with cam roller 43.

Booster cylinder 47 is mounted on the scraper bowl 11 and has a piston 48 therein connected by rod 49 to valve spool 50 of valve 40. The head end of cylinder 47 is connected by conduit 51 to the bowl lift cylinders 16 and the rod end of cylinder 47 is connected by conduit 52 to port 53 of valve housing 46. Valve housing ports 54 and 55 are connected to inlet conduit 38 and exhaust conduit 56, respectively. Valve spool 50 is provided with a passage 57 therethrough for communicating ports 53 and 54 and a separate passage 58 for communicating ports 53 and 55. Spring 59 acts against valve housing 46 and spool 50 to provide a light force to bias cam follower 43 against cam surface 42.

Figure 3:
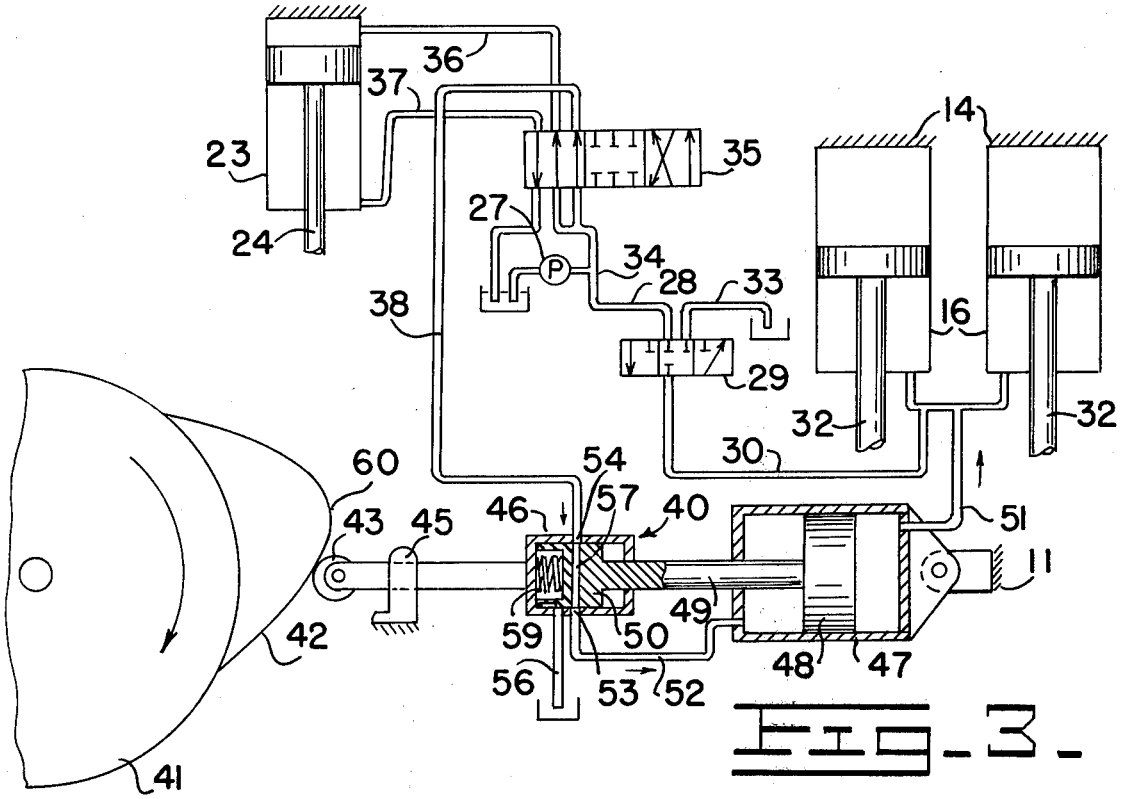
FIGS. 3–5 illustrate the operation of the system of FIG. 2 at different times during pivotal movement of the ejector floor.

In operation, the tractor driver will manually operate valve 29 to adjust the height of the front end of the scraper bowl so that the desired thickness *h* of layer will be spread, and will return vavle 29 to its intermediate position blocking flow through conduit 30. The tractor driver will then actuate valve 35 to cause cylinder 23 and 24 to start pivoting the ejector floor to open position. When the front edge of the floor has moved downwardly below the bottom of the bowl by a distance *d*, cam surface 42 will start to cause cam follower 43 to move to the right. This is turn moves valve housing 46 to the right relative to spool 50, so that valve housing ports 53 and 54 are moved into alignment with spool passage 57, as illustrated in FIG. 3. High-pressure fluid from conduit 38 will now flow through valve 40 and conduit 52 to cylinder 47 to move piston 48 to the right. This in turn will force fluid from the head end of booster cylinder 47 through conduit 51 to bowl lift cylinders 16 to move pistons 31 upwardly and cause the front end of bowl 11 to be raised. The booster cylinder is sized relative to the bowl lift cylinders so that the degree of movement of pistons 31 is proportional to the magnitude of the signal sensed by the cam follower 43 so that the front edge 25 of the ejector floor 19 is raised above the ground (by raising of the front end of the bowl) by an amount equal to the lowering of the front edge 25 beyond the distance *d* below the bottom of the bowl.

If the control valve 35 for ejector floor movement is operated to stop floor opening when the floor has partially opened to the FIG. 3 position, valve 35 will discontinue flow of pressure fluid 38 to the booster cylinder 47 and pistons 48 and 31 will remain at the position to which they have moved to maintain the height adjustment of the bowl.

Figure 4:
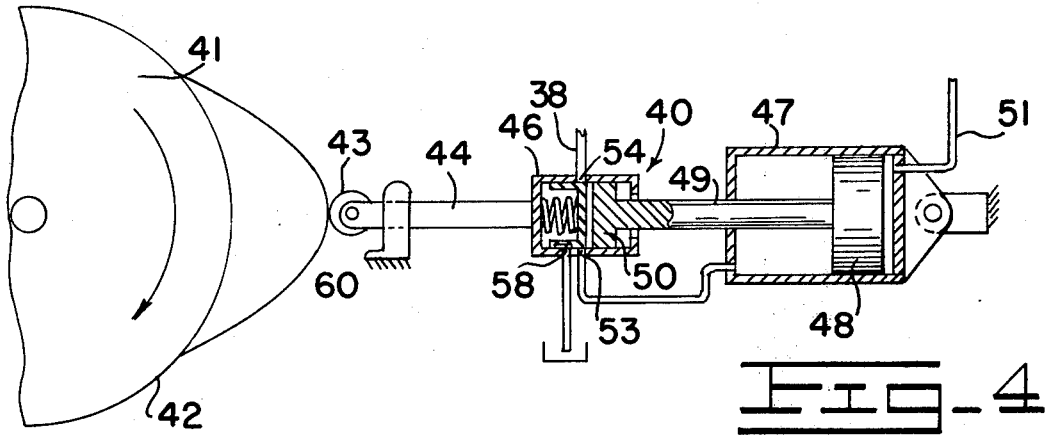
Figure 5:
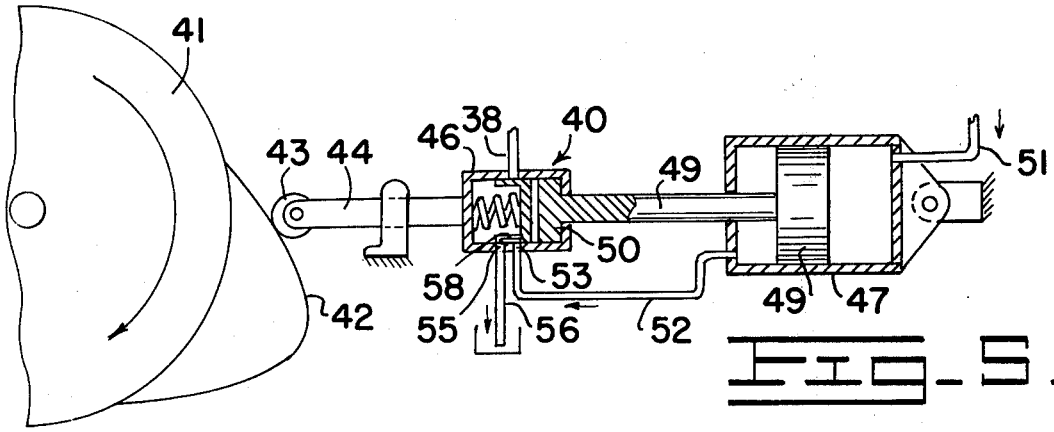

Continued opening of the ejector floor 19 will bring the high point 60 of cam surface 42 into engagement with cam follower 43 when the front edge of the ejector floor has reached its low point relative to the bowl bottom. At this time, valve housing 46 will cease its rightward movement. Flow of pressure fluid from conduit 38 through valve 40 and conduit 52 to booster cylinder 47 will cause piston 48 to move sufficiently to the right so that valve spool 50 is shifted rightwardly enough to move valve spool passage 51 out of communication with ports 53 and 54, thereby stopping further flow of fluid to the booster cylinder. This is the position illustrated in FIG. 4.

Continued opening of the ejector floor 19 will move cam surface 42 so that cam follower begins to move to the left, shifting valve housing 46 to the left so that valve ports 53 and 56 are both brought into communication with spool passage 58. Booster cylinder 47 can now exhaust through conduit 53 and 54 so that booster piston 48 will move to the left, allowing fluid to flow from the bowl lift cylinders back into the head end of the booster cylinder so that the front end of bowl 11 will lower. Thus, booster piston 48 will move to the left in unison with movement of cam follower 43 to the left. Booster piston 48 is limited to such unison movement, since if piston 48 moves further to the left than does cam follower 43, valve spool 50 will move to the left in valve housing 46 and move exhaust spool passage 58 out of registration with port 53, thereby preventing further exhaust of the booster cylinder until such time as exhaust passage 58 again opens to port 53.

Reverse movement of ejector floor 19 from open position to closed position will rotate cam surface 42 in the opposite direction, causing the front end of bowl 11 to raise or lower in accordance with increase or decreases of distance d in the same manner as described above.

Although the hydraulic pressure in conduits 38 and 52 and booster cylinder 47 and conduit 51 may be quite high, e.g. 2000 psi, such pressure is balanced in booster valve 40 so that there is substantially no axial force in valve 40 tending to cause, or appear, relative axial movement of the spool 50 in the housing 46. As a consequence, the only force exerted by cam follower roller 43 in cam surface 42 is that caused by the spring 59.

What is claimed is:

1. In an earth-moving scraper having a scraper bowl with ground-engaging wheels at one end thereof and hydraulically operated bowl lift cylinders at the other end for raising and lowering said other end of said bowl and a floor ejector mounted on said bowl for pivotal movement about an axis transverse to said bowl, the improvement comprising:

signal-producing means operatively associated with said ejector floor for producing a signal during at least a portion of the pivotal movement of said ejector floor about its horizontal axis, said signal having a magnitude proportional to the magnitude of vertical distance of the forward edge of said ejector floor below the bottom of said scraper bowl;

signal-sensing means for sensing the magnitude of said signal; and means operatively associated with said bowl lift cylinders and actuated by said signal-sensing means for operating said bowl lift cylinders to raise or lower said other end of said scraper bowl in response to, and in an amount proportional to, an increase or decrease respectively in the magnitude of said signal.

2. Apparatus as set forth in claim 1 wherein said signal-producing means comprises a cam member having a cam surface movable in unison with said floor ejector, and wherein said signal-sensing means comprises a cam follower in engagement with said cam surface and movable thereby.

3. Apparatus as set forth in claim 1 wherein said means operatively associated with said bowl lift cylinders comprises a booster cylinder having a piston therein, a hydraulic line from said booster cylinder to said bowl lift cylinders whereby movement of said booster piston in one direction in said booster cylinder will force fluid from said booster cylinder to said bowl lift cylinders and movement of said booster piston in the opposite direction will allow fluid to flow from said bowl lift cylinders to said booster cylinder, a source of fluid under pressure, and valve means actuated by said signal-sensing means for communicating said booster cylinder with said source of fluid when the magnitude of said signal increases and for relieving pressure fluid from said booster cylinder when the magnitude of said signal decreases and for maintaining pressure fluid in said booster cylinder when the magnitude of said signal is constant.

4. Apparatus as set forth in claim 3 wherein said signal-producing means comprises a cam member having a cam surface movable in unison with said floor ejector and wherein said signal-sensing means comprises a cam follower in engagement with said cam surface and movable thereby.

5. Apparatus as set forth in claim 4 wherein said cam follower and said booster pistons each have a rod movable therewith, wherein said valve means comprises a valve housing and a valve spool reciprocable therein and wherein said valve housing is connected to one of said rods for movement thereby and said valve spool is connected to the other of said rods for movement thereby.

6. Apparatus as set forth in claim 5 wherein said valve spool has an intermediate position in said valve housing blocking fluid flow to and from said booster cylinder and operative positions in either direction of said spool from said intermediate position for communicating said booster cylinder with said source of fluid under pressure or exhausting said booster cylinder, respectively.

* * * * *